United States Patent [19]

Recard, Jr.

[11] 4,157,184

[45] Jun. 5, 1979

[54] GAME APPARATUS

[76] Inventor: Richard H. Recard, Jr., P.O. Box 34529, Bethesda, Md. 20034

[21] Appl. No.: 827,709

[22] Filed: Aug. 25, 1977

[51] Int. Cl.[2] ..... A63F 3/04

[52] U.S. Cl. ..... 273/253; 273/290

[58] Field of Search ..... 273/242, 250, 253, 255, 273/258, 290

[56] References Cited

U.S. PATENT DOCUMENTS

| | | | |
|---|---|---|---|
| 972,382 | 10/1910 | Johnson-Jervis | 273/255 |
| 3,223,420 | 12/1965 | Turner | 273/253 |
| 3,565,438 | 2/1971 | Bischof | 273/253 |
| 3,709,498 | 1/1973 | Liston | 273/258 X |

FOREIGN PATENT DOCUMENTS

| | | | |
|---|---|---|---|
| 1185805 | 3/1970 | United Kingdom | 273/255 |

*Primary Examiner*—Anton O. Oechsle

[57] ABSTRACT

A game apparatus designed for use by two to four players and including a board essentially divided into hexagonal shaped cells and further including six pentagonal shaped cells as well as a symbol representing a star. The board is used in conjunction with game pieces or markers representing space stations, spacecraft of several different classes and planets revolving about the star. The players take turns moving their spacecraft pieces subject to specific variable constraints with regard to the simulated spacecraft velocity and direction. The markers representing the planets are moved with every turn of each player. If a player's spacecraft is moved to a cell adjacent to another player's spacecraft, one of the spacecraft is eliminated dependent upon the classes of the respective spacecraft and the roll of dice.

12 Claims, 12 Drawing Figures

GAME APPARATUS

CROSS-REFERENCES TO RELATED APPLICATIONS

The essential features of the game board are the subject of copending design patent application Ser. No. 722,120, filed Sept. 10, 1976.

BACKGROUND OF THE INVENTION

A. Field of the Invention

The invention relates to a game apparatus used to simulate the interaction of spacecraft of different stellar civilizations operating in an imaginary solar system. The direction and velocities of the spacecraft take into account the effects of gravity in their simulated travels with the spacecraft having their velocity and direction affected by their interaction with the planets and star of the solar system.

B. Prior Art

Space travel games are well known and there have been numerous patents issued to such games, including U.S. Pat. Nos. 1,538,134; 3,037,773; 3,099,451; 3,223,420; 3,806,126; and 4,010,954. However, none of these prior art games appear to utilize the interactive concepts contained in the present invention.

With regard to the specific board configuration, U.S. Pat. No. 3,917,272 discloses the use of hexagonal cells, but not in the specific configuration of the present invention. As indicated above, the essential features thereof are the subject of the aforementioned copending design patent application.

With regard to the game pieces and the two different velocity indicator embodiments, none of the aforementioned prior art references appear to teach or suggest elements having all of the features of those of the present invention.

SUMMARY OF THE INVENTION

An object of the invention is to provide an interesting and stimulating game apparatus comprising a game board and game pieces or markers used to stimulate the interaction of spacecraft of different stellar civilizations with each other and with the planets and star of a specific solar system.

Another object is to provide a game apparatus wherein the effect of gravity and centrifugal and centripetal acceleration and deceleration on spacecraft is taken into account in the game apparatus.

DESCRIPTION OF THE PREFERRED EMBODIMENTS

Figure 1:
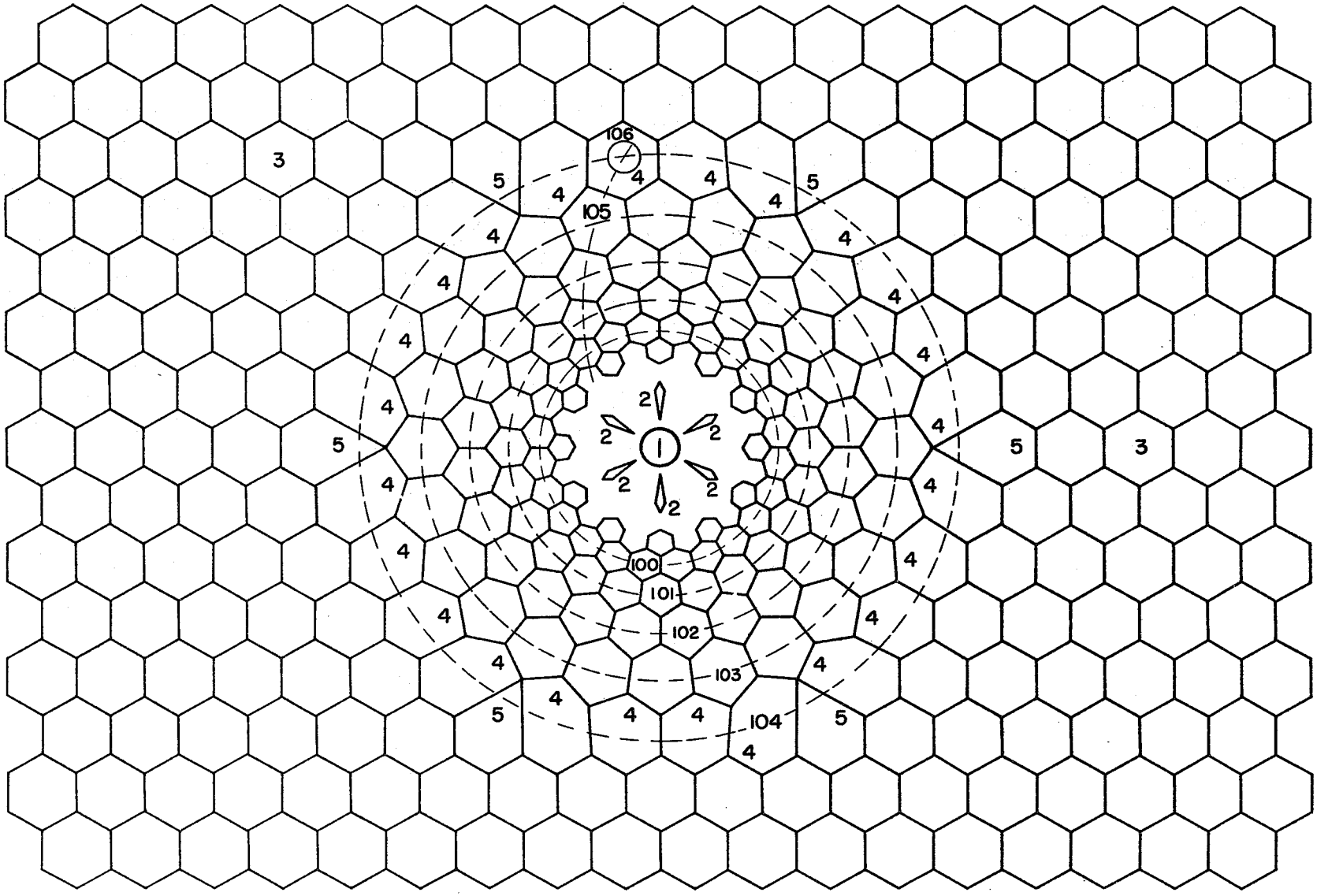
FIG. 1 illustrates the game board according to the present invention.

As illustrated in FIG. 1, the game board comprises a large but fixed number of hexagonal cells 3, 4 surrounding a central element 1, 2 which represents a star in the center of an imaginary solar system. The hexagonal cells vary in size and, as in the case of cells 4, they may not be equilateral hexagons. In addition, also located around central elements 1, 2 are six pentagonal cells 5 arranged equidistant from each other and from the central elements 1 and 2.

Figure 2B:
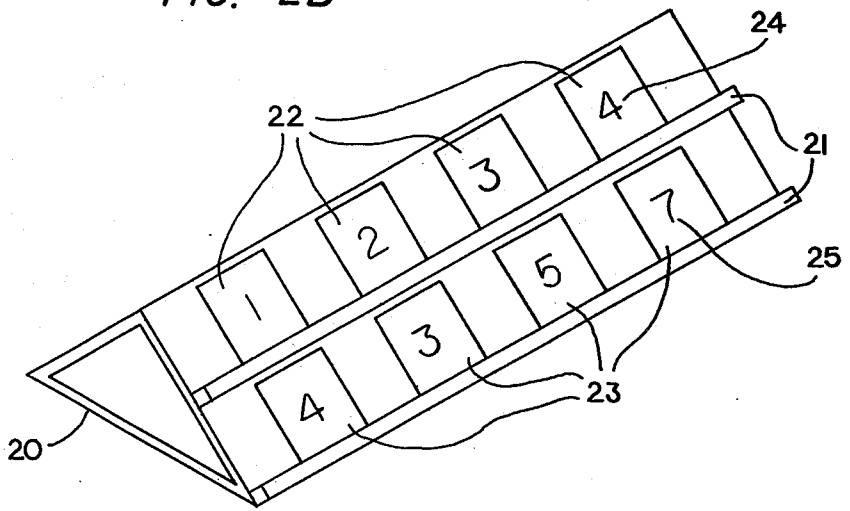
FIG. 2B illustrates a cardholder provided to hold the velocity cards used in one embodiment of the present invention.
Figure 2D:
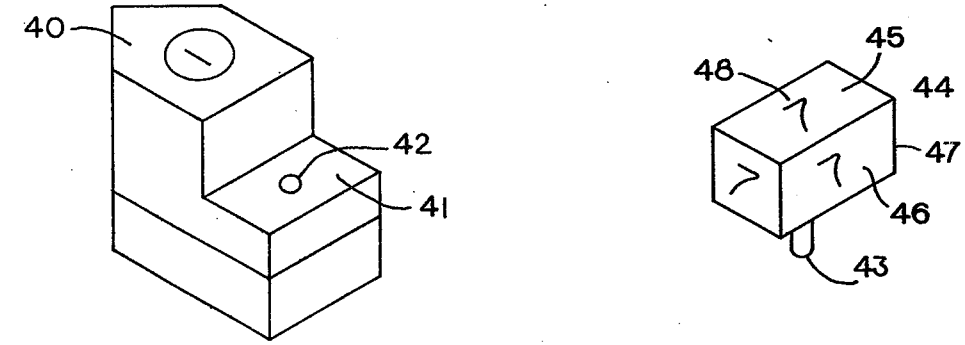
FIG. 2D illustrates a second embodiment of the game pieces used to represent the alpha, delta, and zeta class spacecraft.
Figure 2A:
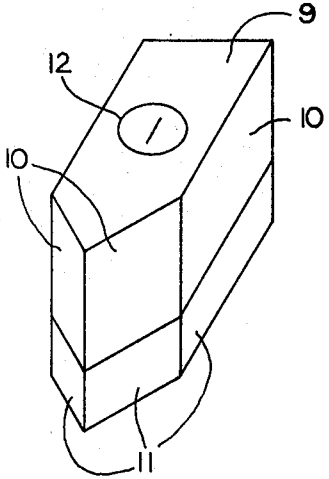
FIG. 2A illustrates one embodiment of the game pieces used to represent the alpha, delta, and zeta class spacecraft.

FIG. 2A illustrates one embodiment of the spacecraft markers used in the present invention. The top 9 as well as the upper sides 10 are painted a solid color, (i.e. blue, green, red, or yellow), to indicate which player the spacecraft game piece belongs to. The bottom front and sides 11 are painted with a different distinguishing color, (i.e. black, silver, or gold), to indicate whether the spacecraft is an alpha, delta, or zeta class spacecraft. The significance of the spacecraft designation will be explained later. On the top 9 of each of these three classes of spacecraft is located a numerical identification 12 used to identify the particular spacecraft. Furthermore, also provided are an additional type of spacecraft game piece, denoted as interceptor class spacecraft and having the same spacecraft structure as shown in FIG. 2A but being painted a solid color corresponding to the colors used for the top 9 and upper sides 10, (i.e. blue, green, red, or yellow), and lacking the identification numbers 12.

FIG. 2B illustrates a velocity indicator assembly used in conjunction with the spacecraft illustrated in FIG. 2A. The velocity indicator assembly may be constructed from a piece of sheet material and has an equilateral triangular cross-section 20 when viewed from the side. The assembly has two ledges 21 arranged such that velocity indicator cards 23 and spacecraft indicator cards 22 may be arranged in a convenient fashion on the velocity indicator assembly. The operation of the velocity indicator cards used in conjunction with the spacecraft of FIG. 2A will be explained below.

Figure 2C:
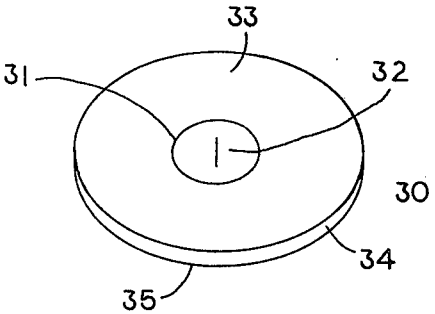
FIG. 2C illustrates the orbit markers provided to symbolize the entry location within the gravity field of a spacecraft initiating a point orbit according to the present invention.

FIG. 2C illustrates the orbit marker pieces with the game providing a corresponding orbit marker for each of the alpha, delta, and zeta class spacecraft. The illustrated marker 30 is in the shape of a coin having an identifying number 31 surrounded by an area 32 having a color corresponding to the class of the corresponding spacecraft (i.e. black, silver, or gold). The remaining areas including the top 33, bottom 35 and side 34 of the marker are painted a color corresponding to that of the particular player to which the marker belongs, (i.e. blue, green, red, or yellow). Accordingly, it is apparent that by suitable choice of colors and numbers, one can provide each of the alpha, delta, and zeta class spacecraft with a corresponding orbit marker.

FIG. 2D illustrates another embodiment of the spacecraft game pieces and the velocity indicator pieces used in conjunction thereof. As noted in the drawing, the spacecraft game piece of the second embodiment is similar to that of the first embodiment with the exception being that there is a step 41 cut out of the top 40. This step 41 enables the affixing of a velocity indicator piece 44 by means of a pin 43 constructed to fit into a hole 42. The color scheme of the spacecraft game pieces of this embodiment is identical to that of the game pieces of the first embodiment. The velocity indicator piece 44 is painted either white or purple and has affixed to its top 45, sides 46 and back 47 a number 48 indicative of the simulated velocity of the spacecraft. The operation of this velocity indicator piece in conjunction with the spacecraft pieces of the second embodiment will be explained below.

Figure 4A:
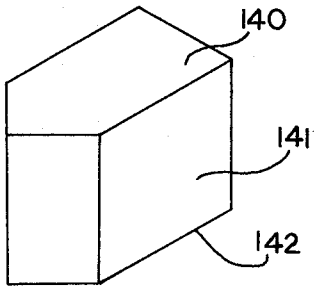
FIG. 4A illustrates the interceptor class spacecraft game piece.

FIG. 4A illustrates the interceptor class spacecraft game piece, The top 140, sides 141 and bottom 142 are painted a solid color (i.e. blue, green, red, or yellow) to indicate to which player a spacecraft belongs.

Figure 4B:
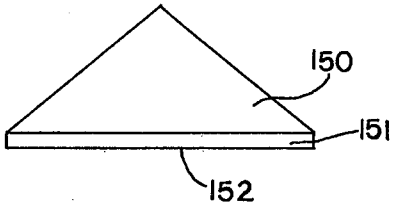
FIG. 4B illustrates the point piece game playing piece.

FIG. 4B illustrates the point piece, which is shaped like a coin and has a triangular face. Its top 150, sides 151 and bottom 152 are purple in color.

Figure 4C:
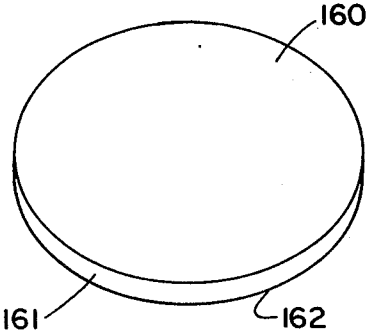
FIG. 4C illustrates the home space station game piece.

FIG. 4C illustrates a home space station game piece. Its diameter is such that it can be inscribed within one of the game board's regular hexagons (FIG. 1–#3). It is coin shaped, and its top 160, side 161 and bottom 162 are painted a solid color (i.e. blue, green, red or yellow) to indicate to which player it belongs.

Figure 4D:
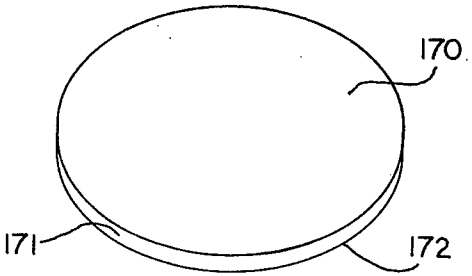
FIG. 4D illustrates the planet Chronos game piece.

FIG. 4D illustrates the planet Chronos game piece. Its diameter is such that it can be inscribed within one of the game board's pentagonal cells (FIG. 1–#50). It is coin shaped, and its top 170, side 171 and bottom 172 are pink in color.

Figure 4E:
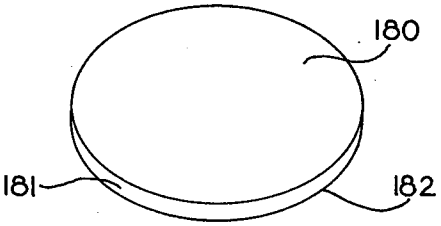
FIG. 4E illustrates the planet Vortex game piece.

FIG. 4E illustrates the planet Vortex game piece. Its diameter is such that it can be inscribed within one of the game board's hexagons comprising the second haxagon ring (FIG. 1–#103). It is coin shaped. The dominant color of its top 180, side 181 and bottom 182 is blue, but the top 180 and bottom 182 have artistic renderings of two different portions of a planetary surface, which makes them distinguishable.

Figure 4F:
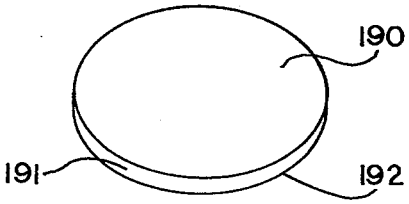
FIG. 4F illustrates the planet Maelstrom game piece.

FIG. 4F illustrates the planet Maelstrom game piece. Its diameter is such that it can be inscribed within one of the game board's hexagons comprising the second hexagon ring (FIG. 1–#101). It is coin shaped. The dominant color of its top 190, side 191 and bottom 192 is purple, but the top 190 and bottom 192 have artistic renderings of two different portions of a planetary surface, which makes them distinguishable.

V. Elimination of an Additional Reference to the Neutronium Game Embodiment

There are also spacecraft identifier cards and velocity identifier cards used in conjunction with the velocity indicator assembly illustrated in FIG. 2B. The spacecraft identifier cards are of a solid color corresponding to the three classes of spacecraft (i.e. black, silver, or gold) and have an identification number 24 on their front corresponding to the identification numbers on the spacecraft game pieces. The velocity identifier cards are white on their face and purple on their back and have numerals on their front 25 and back corresponding to the simulated velocities of the spacecraft. It is to be noted that the spacecraft game pieces and velocity indicator pieces illustrated in FIG. 2D are used alternatively to the spacecraft game pieces and velocity indicator assembly illustrated in FIGS. 2A and 2B respectively.

The only other piece of equipment necessary for the operation of the game would be a pair of ordinary dice. It is, of course, understood that any other device capable of producing a range of numbers with a predetermined frequency distribution could be substituted (i.e.—a wheel of fortune-type spinner or an electronic random number generator).

The aforementioned game board and game pieces may be used to simulate the scenario of the game "Galactiad," which scenario has been copyrighted by the present applicant. Essentially, "Galactia" simulates the sportive competition between spacecraft of different stellar civilizations in a similar fashion to that of the present day Olympic competition. The nature of the sport is the competition between fleets of spacecraft maneuvering in a complex gravity field comprising a solar system, consisting of a star and its associated planets, while attempting to score non-destructive laser hits against spacecraft belonging to opposing fleets. Any spacecraft receiving a non-destructive hit from a laser beam is eliminated from the competition. Each team may potentially bring into the competition three different classes of spacecraft having increasing ability to hit other spacecraft with their lasers and avoid being hit themselves. Each team begins the competition using the first and least powerful class of spacecraft with the object of the spacecraft being to start from the home station and complete an orbit of the star and thence to return to the home station, while eliminating as many opponent spacecraft during his travels as possible. A spacecraft which completes the orbit of the star and returns to the home space station gains one point for the team. The accumulated points may be traded in for additional spacecraft including those of higher classes.

In regard to the simulation scenario per se of the game "Galactiad" it should be apparent to one having ordinary skill in the art that other scenarios may be devised which would correspond to the game rules for the game constructed in accordance with the present invention.

Figure 3:
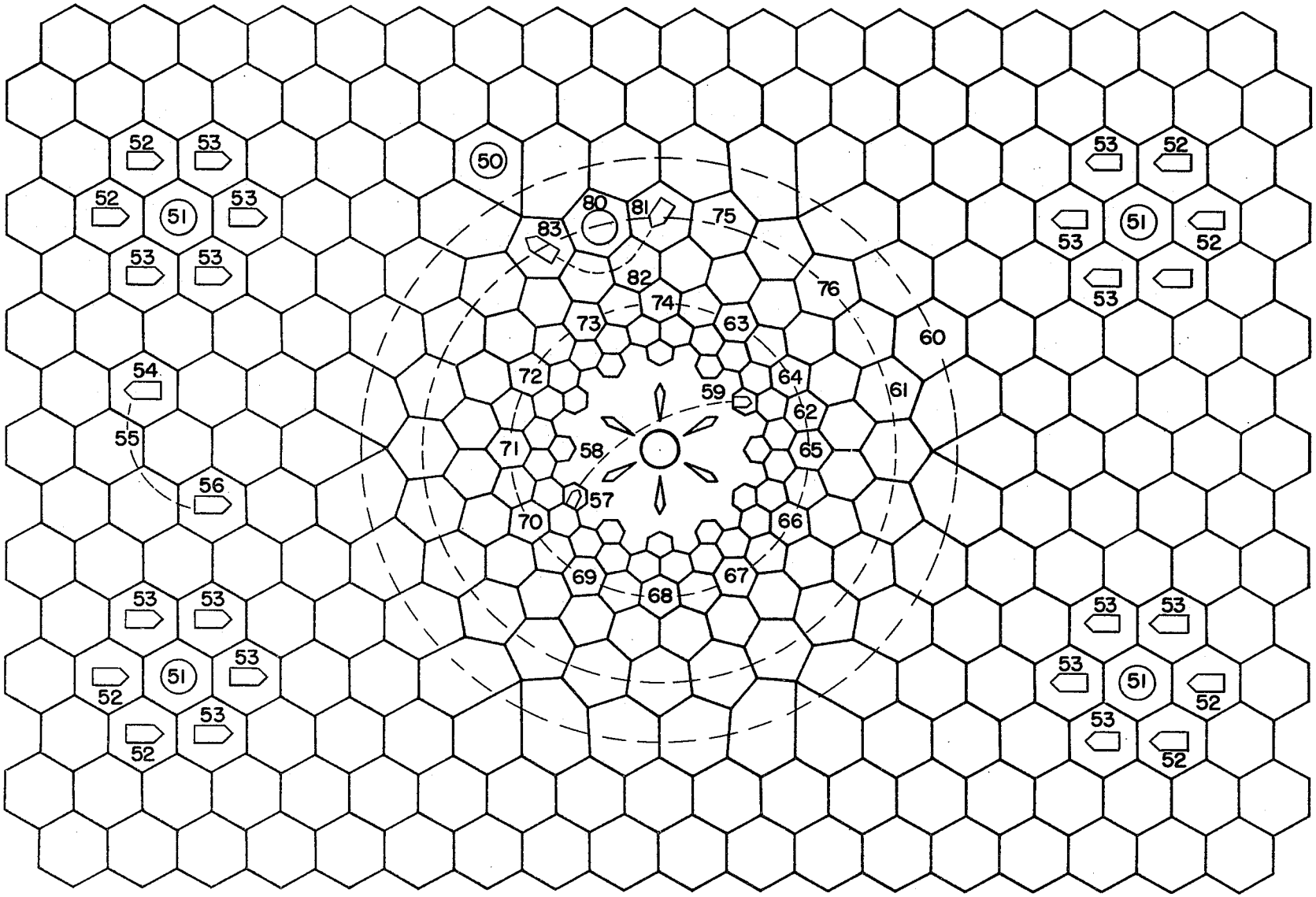
FIG. 3 illustrates the game board with many of the game pieces positioned to facilitate a description of the game rules.

Initially, each player chooses the color of the spacecraft and home space station he will use as well as the playing board corner where he will position his home space station. The location of the home space stations vary and depend on whether two, three or four players are to play the game. FIG. 3 illustrates the positioning of the home stations 51 and their initial spacecraft 52 and 53 for the case of four players. For the case of three players, any one of the home stations 51 and its associated initial spacecraft 52 and 53 may be eliminated. In the case of two players, only the lower two home stations 51 and their associated initial spacecraft 52 and 53 are utilized. However, the initial spacecraft of the lower left home station 51 are rotated sixty degrees in a counterclockwise direction whereas the spacecraft associated with the home space station 51 in the lower right-hand corner are rotated sixty degrees in the clockwise direction. The spacecraft 53 represent alpha class spacecraft while the spacecraft 52 represent interceptor class spacecraft.

There are two possible methods for determining the winner of a game:

(a) The winner is the player who eliminates from the board the spacecraft or home stations of all the other competitors, with the game ending when only his playing pieces remain on the board. A player whose home station is eliminated is removed from the game, even though he may have other spacecraft active on the board. In other words, if the home station is lost, it and all its associated spacecraft are immediately removed from the board.

(b) At the beginning of the game, the players agree upon the number of player turns constituting the game. The revolutions of the planet Chronos are used as an indicator to count the number of turns which have transpired and at the completion of the designated number of player turns, the point value of each of the players' playing pieces remaining on the board is determined, with the player having the greatest number of points being declared the winner. For example, the alpha class spacecraft as well as the point pieces may be considered to be worth one point, the delta class and interceptor class spacecraft may be considered to be worth two points, while the zeta class spacecraft may be considered to be worth three points.

Initially, in the game utilizing the spacecraft game pieces of FIG. 2A in conjunction with the velocity indicator assembly of FIG. 2B, each player positions in his velocity indicator's top slot four black, numbered cards corresponding to the four alpha class spacecraft initially positioned on the playing board. In the velocity indicator's bottom slot, he positions under each black card a white velocity indicator card having the numeral 3. The numeral 3 indicates that the initial velocity of each of the initial spacecraft will be three hexagons per player turn.

In the case of the game utilizing the spacecraft game pieces and velocity indicator pieces of FIG. 2D, the white velocity indicator pieces bearing the numeral 3 are attached to each of the four alpha class spacecraft initially positioned on the playing board.

The two inner planets, named Maelstrom and Vortex, revolve around the central star, named Serene, in the second and fourth orbit out from the star as indicated by the dotted circles 62 and 61 respectively. This may be illustrated on the game board by means of alternately coloring the hexagons contained in their two orbits. The direction of rotation of the two planets is assumed to be, for example, counterclockwise for Maelstrom and clockwise for Vortex and their allowable location considered to be only the alternate hexagons, (i.e. hexagons 63–74). The initial position of Maelstrom is determined by rolling the dice and the sum of the numbers on the dice indicate the hexagon on which Maelstrom begins its orbiting with hexagon 63 corresponding to the number 1, hexagon 64 corresponding to the number 2, etc.

In a similar fashion, the initial location of the planet Vortex is determined with hexagon 75 corresponding to the number 1 and hexagon 76 corresponding to the number 2, etc.

The planet named Chronos revolves around the central star using as its orbital positions the six pentagons arranged on the edge of what is considered to be the star's gravity field and illustrated by the dotted circle 60. Chronos's initial orbital position 50 is shown in FIG. 3.

A throw of the dice by each player may be used to determine which player is the first to move his spacecraft with play then proceeding clockwise around the board.

At the beginning of each player's turn, the player must advance Maelstrom and Vortex one position in their orbits. Both the Maelstrom and Vortex game pieces have two distinctly designed sides such that when the player advances the planet he flips the playing piece over with this feature assisting the player in determining whether or not the planet has been moved.

The planet Chronos is placed in its initial position and moved one pentagon in a clockwise direction after every complete orbit of the planet Vortex.

The numbers printed on each spacecraft are used to identify the spacecraft and serve no other function. Each spacecraft departing from an initial position on one of the six hexagons contiguous to the home station hexagon has an initial velocity (number of hexagons traversed per player turn) of three hexagons. During each turn, a player must move every alpha, delta, or zeta class spacecraft he has active on the board and must traverse the total number of hexagons indicated as its velocity on the velocity indicator. A player has the option of moving or not moving either of his interceptor class spacecraft during his turn.

Only one spacecraft may occupy any hexagon at one time and if a spacecraft's course intersects a hexagon occupied by another spacecraft and if the moving spacecraft has the velocity to carry it beyond the occupied hexagon, then it merely counts the occupied hexagon as one of those traversed in the completion of its move. However, if the moving spacecraft's velocity is such that the completion of its move would bring it to rest on an occupied hexagon, it must stop on the hexagon it reaches immediately before the occupied hexagon.

The movement of the spacecraft inside of the star's gravitational field consists of circular orbits and parabolic trajectories. Complete trajectories carry a spacecraft past the star to the other side of the star's solar system. This is illustrated by the spacecraft initially in the hexagon labelled 57 travelling the parabolic path 58 to the hexagon labelled 59. Hexagons 57 and 59 are directly opposite each other and it is to be noted that the position of the spacecraft is parallel to the parabolic trajectory both at its initiation and completion of movement.

When a spacecraft begins its movement, it may turn no more than one hexagon side from its original direction of travel as it traverses each hexagon. Thus, in order for a spacecraft to make a 180 degree turn, it must traverse three hexagons. As illustrated in FIG. 3, a spacecraft located in hexagon 54 must travel a path 55 and reach hexagon 56, for example, in order to change directions by 180 degrees. However, a spacecraft loses velocity every time it changes direction except under special circumstances explained below. It loses one hexagon of velocity for every turn it makes but the new decreased velocity is not used by the spacecraft until the player's next turn. At the completion of a spacecraft move in which velocity is lost, the decreased velocity is recorded on the velocity indicator by replacing the old white velocity card located under the spacecraft indentifier card with the new white velocity card in the case of the embodiment using the velocity indicator assembly or by replacing the velocity indicator piece on the effected space-craft in the embodiment using the velocity indicator piece in lieu of the velocity indicator assembly.

A spacecraft moving on a parabolic trajectory toward the star may turn with the direction of the curve into a circular orbit around the star without losing velocity. In a similar fashion, a spacecraft moving on a parabolic trajectory away from the star may turn with the direction of the curve into a circular orbit around the star without losing velocity. Furthermore, a spacecraft traveling in a circular orbit around a star may move into either a lower or higher circular orbit, continuing in the same direction without losing velocity.

Within the gravity field of the star, a spacecraft moving on a parabolic trajectory either toward or away from the star, turning against the direction of the curve into a circular orbit around the star loses one hexagon of velocity per player turn.

With regard to the six pentagon spaces used as orbiting positions for Chronos, they are never landed on by the spacecraft but are always skipped over and when a spacecraft skips over a pentagon it does not count as one of the hexagons traversed. While a traversal of a pentagon may include a direction change, there is no loss of velocity.

When a spacecraft comes into the gravity field of either of the planets, the gravity fields of these planets may be used to accelerate the spacecraft by an additional hexagon of velocity per player move. This is illustrated in FIG. 3 by the spacecraft located in hexagon 81 which follows the path 82 to hexagon 83. When the spacecraft lands in hexagon 81 when the planet is located in hexagon 80, the spacecraft may be immediately moved to hexagon 83 without counting the hexagons traversed as part of the total number of hexagons allowed. In addition, when the spacecraft has finished its move, the velocity indicator means is updated to indicate a new increased velocity.

When a spacecraft occupies a hexagon which is contiguous with a hexagon occupied by a spacecraft of another player, that spacecraft may fire its laser in an attempt to score against and eliminate the other spacecraft. A spacecraft may fire upon aother spacecraft regardless of the direction that the antagonist spacecraft is facing and the attack may occur in the course of the antagonist spacecraft's move, while it is passing the other spacecraft. Whether or not the laser scores against the spacecraft of another player is simulated by the roll of dice with the dice being used to define a probability distribution of a "hit." When the dice are rolled, the sum of the numbers on the top faces are compared to a critical number and when that sum is less than or equal to the critical number, a "hit" is declared and the "hit" spacecraft is removed from the playing board. Table 1 defines the critical number for the interaction of the various classes of spacecraft. It is to be noted that the home station can be fired upon but has no lasers of its own.

TABLE 1

| columns → rows ↓ | Probability That Spacecraft of Class in Columns Will Eliminate Spacecraft of Class in Rows | | | | | | | |
|---|---|---|---|---|---|---|---|---|
| | ALPHA (black) | | DELTA (silver) | | ZETA (gold) | | INTERCEPTOR | |
| | P | ≤ C.N.* | P | ≤ C. N. | P | ≤ C. N. | P | ≤ C. N. |
| ALPHA | 28% | 5 | 72% | 8 | 97% | 11 | 72% | 8 |
| DELTA | 17% | 4 | 58% | 7 | 97% | 11 | 58% | 7 |
| ZETA | 3% | 2 | 28% | 5 | 97% | 11 | 28% | 5 |
| INTERCEPTOR | 17% | 4 | 58% | 7 | 97% | 11 | 58% | 7 |
| HOME SPACE STATION | 17% | 4 | 58% | 7 | 97% | 11 | 58% | 7 |

*C. N. = Critical Number = sum of numbers on die faces using cubic dice

With regard to the interceptor class spacecraft, these spacecraft may move only outside the star's gravitational field and, in addition, may not fire upon spacecraft inside of the gravity field while conversely, spacecraft located inside the gravitational field may not fire upon the interceptor class spacecraft. A player has the option of not moving the interceptor class spacecraft or moving either one or both of the spacecraft during a player turn. When an interceptor class spacecraft is moved, it may traverse either one or two hexagons per turn and may make a sixty degree turn in either one or both of the hexagons it traverses without a velocity loss.

A fundamental goal of each player is to orbit the star with each spacecraft in order to gain "points". In the case of a game played with three or four players, five circular orbits, illustrated as orbits 100–104 in FIG. 1, may be used to obtain points. The orbit is considered to have begun at the first hexagon traversed by the spacecraft in orbit 104. An orbit marker corresponding to that spacecraft is placed in the aforesaid traversed hexagon and the spacecraft must make a complete revolution around the star until the spacecraft reaches either the hexagon containing the orbit marker or reaches any of the five hexagons located along a parabolic trajectory beginning at the orbit marker as illustrated by line 105 in FIG. 1. The spacecraft may move toward or away from the star while orbiting as long as the spacecraft continues in the direction (clockwise or counterclockwise in which it was moving when it traversed the initial hexagon upon which its orbit marker was placed.

When a spacecraft completes its point orbit, its orbit marker is removed from the board and either the velocity identifier card is reversed from its white side to its purple side or the white velocity indicator piece is replaced by a purple velocity indicator piece. When that spacecraft lands on one of the six hexagons contiguous to its home station hexagon, the velocity identifier card is again reversed to white or the velocity indicator piece changed to a white piece and a point piece is placed on the home station hexagon. The spacecraft is then repositioned on that hexagon in accordance with the initial alignment of the alpha class spacecraft initially placed on that hexagon at the beginning of the game, and with the initial velocity of 3.

New spacecraft, which are provided in exchange for the point pieces, are placed on any unoccupied hexagon contiguous with the home station hexagon. This is done only at the completion of a player's turn and the new spacecraft is not moved until the player's following turn.

A new alpha class spacecraft requires the exchange of one point piece, while a delta class or intercepter class spacecraft requires the exchange of two point pieces. In addition, a zeta class spacecraft requires the exchange of three point pieces. The only rule governing the order in which the spacecraft can be introduced into the game is that before a player can exchange point pieces for a zeta class spacecraft, he must have previously exchanged point pieces for at least one delta class spacecraft.

The orbiting procedures for two players are essentially the same as that for three or four players with the exception being that orbits labelled 103 and 104 in FIG. 1 are eliminated for use as point orbits with the orbit label 102 being the initiating the point orbit.

If an attacked spacecraft has an associated point piece and is hit, the attacking spacecraft claims the point piece in addition to eliminating the attacked spacecraft.

While preferred forms and arrangements have been shown in illustrating the invention, it is to be clearly understood that various changes in detail and arrangement may be made without departing from the spirit and scope of this disclosure.

What is claimed is:

1. A game apparatus for use by a plurality of players and comprising:

a flat game board essentially divided into hexagonal shaped cells arranged around a central symbol representing a star and further including a plurality of pentagonal shaped cells located around said central symbol;

a plurality of game markers representing three classes of spacecraft, each of said game markers having both two distinguishing colors and additional markings, wherein one color on each game marker represents the player to which it belongs and a second color on each game marker represents the class of the spacecraft it represents while the additional marking represents the spacecraft number;

a plurality of additional game markers also representing an additional class of spacecraft, each of said additional game markers having only a single distinguishing color representing the player to which it belongs;

a plurality of game markers representing space stations, each of said markers having a distinguishing color representing the player to which it belongs;

a velocity marker means having numbers used to represent the simulated velocities of each spacecraft of the three classes of spacecraft and two distinguishing colors used to represent the respective completion or non-completion of a specified orbit of a specified spacecraft;

a plurality of game markers, each of which represent a planet;

a plurality of orbit game markers having both distinguishing colors and markings, each corresponding to a single respective game marker representing one spacecraft of one of the three classes of spacecraft;

a plurality of score game markers which represent a completed orbit around the central star symbol by a spacecraft;

a random function means for providing an integer from a range of integers with a predetermined frequency distribution;

said players taking turns in moving their spacecraft game pieces from hexagon shaped cell to hexagon shaped cell with the number of cells traversed in each player's turn equal to the number specified by said velocity marker means;

said players moving some of said planet game markers two hexagon cells with each turn so as to trace a circular path around said star.

2. A game apparatus as in claim 1, wherein said velocity marker means comprises an easel having upper and lower ledges, the upper ledge arranged to support a plurality of spacecraft identification cards, each having a color and number corresponding to a specific spacecraft game marker while the lower ledge is arranged to support a plurality of velocity indicator cards each bearing said number indicative of the simulated velocity of the spacecraft game marker represented by the identifier and situated immediately above on said easel and having said two distinguishing colors on opposite faces of said cards.

3. A game apparatus as in claim 1, wherein said velocity marker means comprises an object with a rectangular shaped face and having a fastening means arranged so as to be fastened to said spacecraft game markers, such of said objects having said number indicative of the simulated velocity of the spacecraft game marker to which it is fastened and one of said two distinguishing colors.

4. A game apparatus as in claim 1, wherein at least two of said planet game markers are coin shaped with different markings on either side thereon to enable distinguishing the two sides.

5. A game apparatus as in claim 1, further comprising specified circular orbits around said star symbol and wherein said orbit game markers are placed on the hexagonal cell from which its corresponding spacecraft game marker has originated a tracing path essentially following said circular orbits, with said game marker being removed when said spacecraft game marker has completed said tracing path and returned to the hexagonal cell containing its orbit marker.

6. A game apparatus as in claim 1, wherein at least one of said score markers, each awarded to a player whose spacecraft game piece has completed an orbit of said star symbol, may be exchanged by said player for an additional spacecraft game piece, with the exchange rate fixed prior to commencing the playing of said game.

7. A game apparatus as in claim 1, wherein a spacecraft game piece of one of the three classes of spacecraft may, when located outside the specified region of circular orbits concentric with said central star symbol and at the discretion of the player owning said game piece, change its direction within any hexagonal cell traversed; and wherein every directional change reduces the velocity of said game piece.

8. A game apparatus as in claim 1, wherein a spacecraft game piece of one of the three classes of spacecraft may, when located inside the specified region of circular orbits concentric with said central star symbol and at the discretion of the player owning said game piece, change its direction from a circular trajectory to a parabolic trajectory or from a parabolic trajectory to a circular trajectory; and wherein each of said two types of direction change either reduces or has no effect upon the velocity of said game piece, according to rules specified at a game's beginning.

9. A game apparatus as in claim 1, wherein a spacecraft game piece gains velocity when tracing a path which at least partially orbits a cell containing a planet game marker and is contiguous with said cell.

10. A game apparatus as in claim 1, wherein one of said remaining planet game markers is placed on a pentagonal shaped cell initially and then moved to the next nearest pentagonal shaped cell after a specified one of said other planet game markers has traced a circular path around the star and has been returned to its initial position; and wherein the completion of a predetermined number of orbits by said remaining planet game maker determines the completion of a game.

11. A game apparatus as in claim 1, wherein said game pieces representing said additional spacecraft are restricted to a region outside of a gravity field defined to be a specified circular region concentric with said star, their velocity being constant.

12. A game apparatus as in claim 1, wherein a spacecraft game piece may cross from one side to another of the game board's central, non-tessellated region, in which maneuver the spacecraft uses as a guide for its trajectory the ray elements of the central star symbol, which ray elements are the spokes radiating away from the central circle; beginning on any one of the twelve hexagons which are separated by gaps and form the ring of hexagons in closest proximity to the central star symbol, the rays and spaces between rays may be used to guide said spacecraft on trajectories that result in their crossing to one of the remaining said twelve hexagons, according to rules specified at a game's beginning.

* * * * *

UNITED STATES PATENT AND TRADEMARK OFFICE

CERTIFICATE OF CORRECTION

PATENT NO. : 4,157,184

DATED : June 5, 1979

INVENTOR(S) : Richard H. Recard, Jr.

It is certified that error appears in the above—identified patent and that said Letters Patent is hereby corrected as shown below:

Column 3, lines 52-54, "V. Elimination of an Additional Reference to the Neutronium Game Embodiment" should be deleted.

Signed and Sealed this

*Eleventh* Day of *March 1980*

[SEAL]

*Attest:*

SIDNEY A. DIAMOND

*Attesting Officer*

*Commissioner of Patents and Trademarks*